US007577269B2

(12) United States Patent
Adelman

(10) Patent No.: US 7,577,269 B2
(45) Date of Patent: Aug. 18, 2009

(54) ACOUSTIC TRANSDUCER

(75) Inventor: Roger A. Adelman, Villa Hills, KY (US)

(73) Assignee: Technology Properties Limited, Cupertino, CA (US)

( * ) Notice: Subject to any disclaimer, the term of this patent is extended or adjusted under 35 U.S.C. 154(b) by 70 days.

(21) Appl. No.: 11/511,170

(22) Filed: Aug. 28, 2006

(65) Prior Publication Data

US 2008/0049967 A1 Feb. 28, 2008

(51) Int. Cl.
*H04R 1/00* (2006.01)

(52) U.S. Cl. ..... 381/417; 381/424

(58) Field of Classification Search ..... 381/150, 381/396, 398, 412, 417, 418, 420, 421; 340/384.73, 340/388.4, 391.1; 367/175
See application file for complete search history.

(56) References Cited

U.S. PATENT DOCUMENTS 6,920,230 B2 * 7/2005 Usuki et al. ..... 381/396
7,187,779 B2 * 3/2007 Usuki et al. ..... 381/412

FOREIGN PATENT DOCUMENTS

| | | |
|---|---|---|
| GB | 227560 | 1/1925 |
| GB | 670027 | 4/1952 |

* cited by examiner

*Primary Examiner*—Brian Ensey
(74) *Attorney, Agent, or Firm*—Porter Wright Morris & Arthur LLP

(57) ABSTRACT

A transducer utilizes a sound-producing member positioned in the area of magnetic flux concentration between magnetic poles of opposite polarity. The sound-producing member is variably vibratable in a magnetic structure between the poles to generate acoustic waves, and an acoustic conduit carries the acoustic waves through the magnetic poles e to a location outside the magnetic structure.

22 Claims, 5 Drawing Sheets

Fig 3
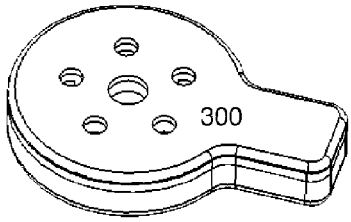
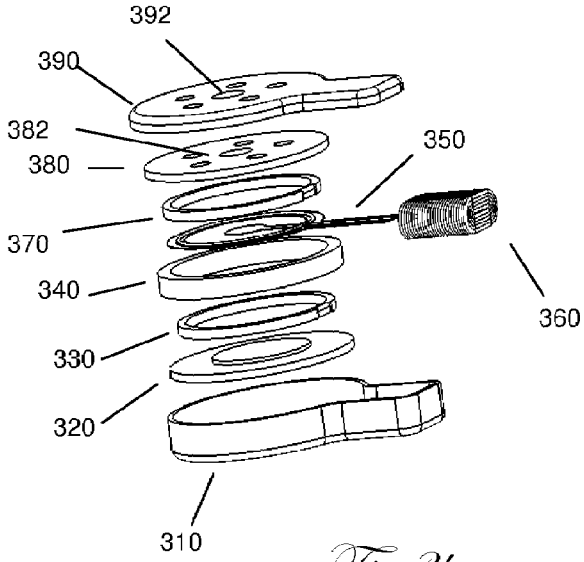
Fig 3b
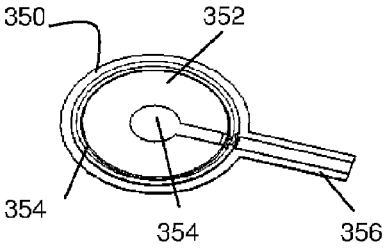
Fig 3c
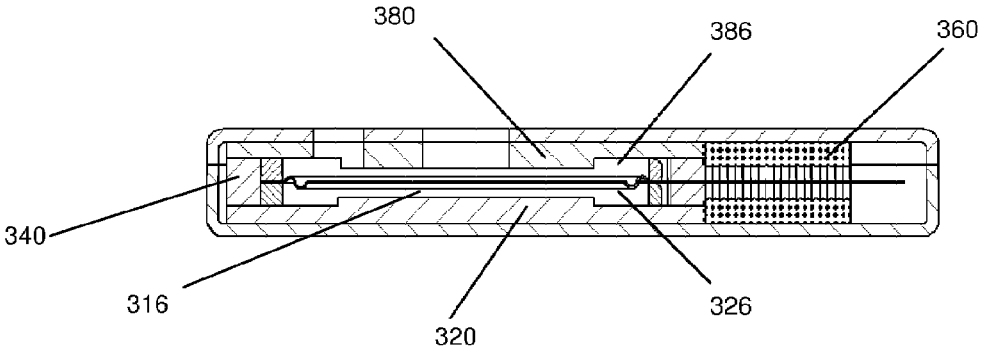
Fig 3a

ACOUSTIC TRANSDUCER

FIELD OF THE INVENTION

The present invention generally relates to the field of electro acoustic transducers. While the invention has applicability to a wide range of diverse applications, it will be specifically disclosed in connection with a class of electro acoustic transducers commonly referred to as "micro speakers" or "receivers" in the hearing aid industry. Transducers constructed in accordance with the principles of the invention also can be used in some applications to convert acoustic energy to electrical energy, i.e. as a microphone.

BACKGROUND

Balanced armature electro acoustic transducers have long been fundamental components of communications equipment ranging from telephones to hearing aids. Very early telephones utilized balanced armature transducers in their earpieces and such speakers took on the name of the entire hand piece and became known as "receivers." In keeping with this commonly used terminology, the terms "speaker" and "receiver" will be used interchangeably in this specification.

In hearing aid applications, balanced armature devices have been used for both microphones and "receivers." While other technologies, notably "electrets," have largely supplanted the use of balanced armature transducers as microphones in the specific context of hearing aids, balanced armature devices continue to be the most commonly used technology for "receivers" in present day hearing aids. Most advantageously, balanced armature devices can produce extremely loud sounds with very little power and within a very small geometric volume and footprint.

A limitation to the performance of conventional balanced armature electro acoustic devices, whether used as speakers or microphones, is that their characteristic frequency spectra deviate from being perfectly flat, spectral flatness being one representation of a lack of distortion, a very desirable characteristic for acoustic (and most other) transducers. This spectral deviation or "signature" arises from the fundamental structural properties that are characteristic of all conventional balanced armature devices: the mass and springiness of: the armature itself, the sound producing diaphragm and its chamber(s), and of the connector element and its attachments that link the armature and the diaphragm. More particularly, the beam and connecting rod of the armature, the diaphragm, and even the air and ports into which the air exits all have associated masses and springiness, and the system has a characteristic resonance that reflects the energy exchange between such masses and springs. Numerous techniques have been developed to minimize the disadvantages of this inherent signature, including, for example, the use of so-called "ferrofluids" for damping the system and improving the transducer's dynamic performance.

Notwithstanding the substantial enhancements to these general types of transducers, room remains for improving and simplifying the frequency signature and minimizing the frictional and other mechanical losses. Substantial room further exists for enhancing the relationship to the non-linear magnetic forces with a corresponding non-linear springiness of the armature/diaphragm. In many applications, it also is desirable to further reduce the size of the transducer. For example, when used in a hearing aid or earphone application, it is desirable to have a transducer that is small enough to comfortably fit within a human auditory canal. Similarly, when used as a component of a device, such as a cell phone, the small size of the transducer allows the size of the device to be minimized.

SUMMARY OF THE INVENTION

The present invention advantageously overcomes many of the disadvantages of the prior art by eliminating all of the individual elements comprising the sound producing/receiving diaphragm and the armature, effectively integrating these components into a single "balanced diaphragm" element. By integrating these multiple components into a single functional component, the frequency signature of these devices is greatly simplified. Furthermore, providing a sound conduction pathway through the magnetic structure in which the diaphragm is balanced, the sound producing or receiving balanced diaphragm element can be located entirely within the fluid (air or other) gap between the magnetic poles and still remain in substantially direct communication with fluid (air or other) in the environment. Particular choices for the spring, mass and damping characteristics of the balanced diaphragm and its containing chambers and conduits, (or multiple instances of the same) enable improved spectral control in this simplified, integrated system over the multi-element system it supersedes. A two-diaphragm version of the concept minimizes part vibration and allows for enhanced acoustic performance, for example, a micro-woofer micro-tweeter combination.

To achieve one or more of these objectives, one exemplary embodiment provides an electro-magnetic transducer that includes a magnetic structure with at least two magnetic poles of opposite polarity. The structure includes at least two magnetic poles of opposite polarity that create an area of magnetic flux concentration. A vibratable sound-producing member at least partially formed of magnetically permeable material and vibratable toward and away from the magnetic poles is disposed in the area of magnetic flux concentration. The sound-producing member vibrates toward and away from the magnetic poles to produce acoustic waves in the area of magnetic flux in response to electrical current passing through the coil. An acoustic conduit is provided for receiving sound waves generated by the sound-producing member and directing such waves from the area of magnetic flux concentration to a location outside the magnetic structure.

In at least one exemplary embodiment, the area of magnetic flux concentration is located between the magnetic poles of opposite polarity.

In one exemplary embodiment, the sound-producing member is generally positioned in a plane substantially equidistance between the magnetic poles.

In one exemplary embodiment, a support structure is provided for engaging and supporting the peripheral portions of the sound-producing member.

In one exemplary embodiment, the peripheral support structure for the sound-producing member is compliant.

In one exemplary embodiment, a flux concentrator, the transducer includes a flux concentrator, and the flux concentrator supports the coil about an axis.

In one exemplary embodiment, the flux concentrator supports the coil about an axis extending substantially perpendicular to the plane of the sound-producing member.

In one exemplary embodiment, the flux concentrator supports the coil about an axis extending substantially parallel to the plane of the sound-producing member.

In one exemplary embodiment, the sound-producing member includes a diaphragm.

In one exemplary embodiment, the sound-producing member is variably vibratable in response to varying electrical current passing through the coil.

In one exemplary embodiment, the acoustic conduit for receiving sound waves generated by the sound-producing member extends through the magnetic structure.

In one exemplary embodiment, the electro-magnetic transducer includes a case in which the magnetic structure is supported. The case includes at least one acoustic conduit aligned with the acoustic conduit extending through the magnetic structure. The acoustic conduit extending through the magnetic structure cooperates with the acoustic conduit of the case to joint form an acoustic pathway extending from the flux area to outside the case.

In one exemplary embodiment, at least one acoustic cavity is formed within the case.

In one exemplary embodiment, an electro-magnetic transducer includes a magnetic structure formed by an annular magnet; a first pole piece magnetically connected to the annular magnet and a second pole piece magnetically connected to the annular magnetic. The first and second pole pieces form magnetic poles of opposite polarity with an area of magnetic flux concentration being formed between the pole pieces. A sound producing structure is interposed in the area of magnetic flux concentration between the first and second pole pieces. The sound producing structure is at least partially formed of magnetically permeable material and is operable to produce acoustic waves in the area of magnetic flux concentration between the pole pieces. A coil is located in proximity to the sound producing structure with the sound producing structure being variably vibratable toward and away from the first and second pole pieces to produce acoustic waves in the area of magnetic flux concentration in response to variable electrical current passing through the coil. An acoustic conduit extends through one of the pole pieces for permitting the passage of an acoustic wave through the magnetic structure. The sound-producing surface is operative to generate sound waves in the flux area and to direct such waves through the acoustic path extending through the magnetic structure to an external sound environment.

In one exemplary embodiment, the magnetic structure is supported in the case, and the case includes at least one acoustic conduit aligned with the acoustic conduit extending through the magnetic structure. The acoustic conduit(s) extending through the magnetic structure and the acoustic conduit(s) of the case jointly form an acoustic pathway extending from the flux area to outside the case.

In one exemplary embodiment, an electro-magnetic transducer includes a magnetic structure that includes at least two magnetic flux fields between magnetic poles of opposite polarity. A sound producing structure is disposed in each of the two magnetic flux fields. Each of the sound producing structures is at least partially formed of magnetically permeable material and is located between magnetic poles of opposite polarity. A coil is located in proximity to each of the sound producing structures. Each of the sound producing structures are variably vibratable toward and away from the magnetic poles to produce acoustic waves in the flux areas in response to varying electrical current passing through the coil. A plurality of acoustic conduits extends through the magnetic structure to an external sound environment.

BRIEF DESCRIPTION OF THE DRAWINGS

The accompanying drawings incorporated in and forming a part of the specification illustrate several aspects of the present invention, and together with the description, they serve to explain the principles of the invention. In the drawings:

FIG. 3 is a perspective view showing the exterior of one exemplary embodiment illustrating some of the principles of the present invention in the form of a single diaphragm receiver;

FIG. 3*a* is a cross-sectional view of the exemplary embodiment of FIG. 3;

FIG. 3*b* is an exploded view of the exemplary embodiment of FIG. 3;

FIG. 3*c* is a perspective view of an integrated armature/diaphragm used in the exemplary embodiment of FIG. 3;

Reference will now be made in detail to certain exemplary embodiments of the invention, examples of which are illustrated in the accompanying drawings.

DETAILED DESCRIPTION OF EXEMPLARY EMBODIMENTS

The specifically illustrated exemplary embodiments relate to an acoustic transducer that minimizes frictional and other mechanical losses. When used in connection with a balanced armature type of transducer, these exemplary embodiments advantageously eliminate a connector element by integrating the armature and diaphragm. Acoustic conduits, specifically shown in the exemplary embodiments as holes in the poles of the magnets of the transducer, provide acoustic coupling between the integrated armature/diaphragm and the external sound environment.

Figure 1:
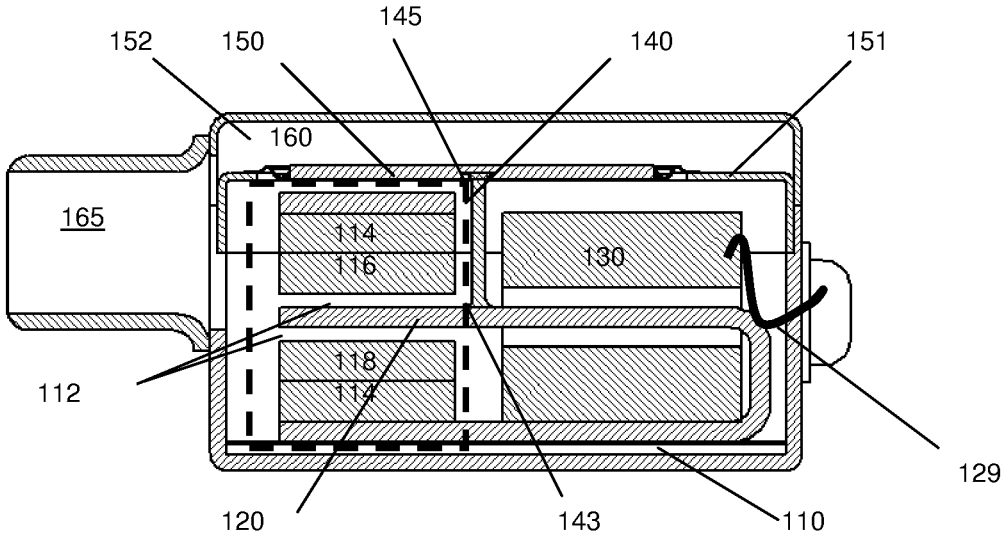
PRIOR ART Fig. 1
FIG. 1 is a cross-sectional view of a typical prior art balanced armature acoustic transducer in its application as either a microphone or a speaker.

Certain aspects of the illustrated exemplary embodiments are best appreciated by a comparison with conventional balanced armature type transducers of a type similar to these exemplary embodiments illustrated. Referring specifically now to the drawings, FIG. 1 is a cross sectional depiction of a conventional state of the art balanced armature acoustic transducer 100. This particular illustrated prior art transducer 100 includes a permanent magnet 114 with having a "north" pole 116 and a "south" pole 118 and an air gap 112 located between the poles 116 and 118. The magnet 114 produces a magnetic field in an air gap 112. In this conventional prior art transducer, a free end of a beam 120 extends into the air gap 112. The beam 120 is made of magnetically permeable material and is supported in a cantilever fashion. A mechanical bond between the beam 120 and an internal surface of the housing 100 is provided at location 110 to secure a fixed end of the beam 120 such that the free end of the beam is centered between poles 116 and 118 in the air gap 112. An electrical coil 130 created from turns of insulated conductor 129 is wound around a portion of beam 120 such that an electric solenoid is created whose beam 120 "core" is a dipole magnet. One end of a connecting rod 140 is connected to the free end of beam 120 through a joint 143. The other end of the connecting rod 140 is connected to a sound-producing surface 150 through a joint 145. The sound producing surface 150 has a compliant supporting peripheral portion or "surround" 152 at its outermost edge, and this outermost edge forms an acoustic seal along its periphery as it attaches to a supporting structure 151, which supporting structure 151 extends inwardly from an interior surface of the structural housing 100 and forms a floor of an acoustic chamber structure 160. The acoustic chamber structure 160 has an output port 165 to which a conduit or other acoustic conveyance (not shown) can be attached to direct sound energy to the external acoustic environment, typically a wearer's outer ear.

Figure 2:
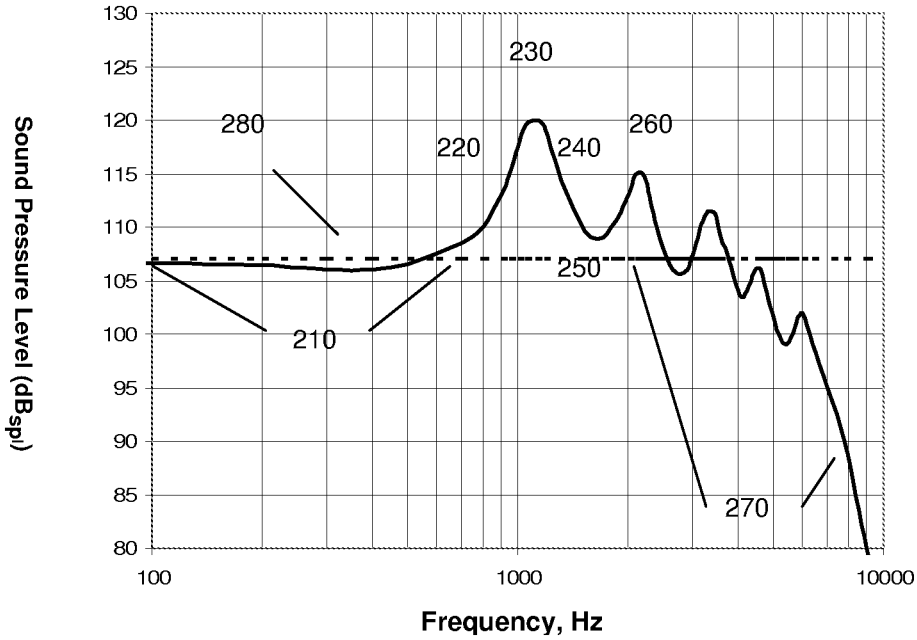
PRIOR ART Fig. 2
FIG. 2 is a graphical representation comparing the frequency responses or spectra for prior art transducers to an ideal condition for a transducer used a speaker.

FIG. 2 depicts a comparative frequency response plot between representative of the acoustic output of a conventional state of the art balanced speaker, such as the speaker illustrated in FIG. 1, and the response of an ideal receiver in response to a constant input of electrical current. The abscissa of the plot depicted in FIG. 2 is logarithmic frequency, and the ordinate representing decibels of sound pressure level, also a logarithmic form of measure. The solid line represents the spectral plot 200 for a typical existing state of the art balanced diaphragm receiver, such as illustrated in FIG. 1. This solid line is comprised of a relatively flat zone 210, followed by a rising region 220, resulting in a first peak 230 occurring at approximately 1100 Hz, followed by its declining region 240, which reaches a trough 250 at approximately 1600 Hz, which is followed by a second peak at 260 at approximately 2200 Hz, and a continuum of repeated peaks and valleys in region 270 at the upper extent of the spectral plot. The frequently response of a conventional transducer is compared to that of an ideal receiver, which is depicted in the straight dashed spectral plot 280. The spectral plot of line 280 represents the theoretically flat response of an ideal receiver whose output in response to a constant input energy as a function of frequency would be a constant and uniform acoustical output as a function of frequency.

FIGS. 3, 3*a* and 3*b* show a first exemplary embodiment of the present invention in a form utilizing a "straight armature" receiver. In this exemplary embodiment, a transducer is enclosed within a structural housing 300 that encloses the transducer. The structural housing 300 contains a magnet 340 (see FIGS. 3*a* and 3*b*), which in this specifically illustrated embodiment has an annular configuration. A magnetic field is produced in an air gap or magnetic flux area 316 located between the opposite magnetic poles formed between an upper magnetic pole piece 380 and a lower pole piece 320. Exemplary suitable permeable ferro-magnetic materials from which pole pieces 380 and 320 might be made include the iron-based "High mu 80" (Carpenter Steel Corporation). In the exemplary form illustrated, an acoustic conduit is formed in upper pole piece 380 by piercing through the upper pole piece to form holes 382. The illustrated exemplary embodiment further includes correspondingly aligned holes 392 (see FIG. 3*b*) in upper case portion 390. These aligned holes form an acoustic path through which a fluid, such as air, maintains contiguous relationship with fluid present on the inside of pole piece 380 and the outside of upper case 390. The magnetic structure, exemplarily illustrated as an annular magnet 340 may be a permanent magnet or it may be an electromagnet built using well-known principles of winding a coil around a magnetically permeable form. As those skilled in the art will readily appreciate, if an electromagnet is used, an electric current is supplied to the coil to form a magnetic field.

As best illustrated in FIG. 3*c*, this exemplary embodiment includes a vibratable sound-producing member, specifically illustrated in this drawing figure as an armature that is integrated with a diaphragm. The illustrated armature/diaphragm 350 includes at least a portion of magnetically permeable material 358. The illustrated armature/diaphragm 350 also has a cantilevered geometry with a base that is rigidly affixed to a magnetic coil structure 360. The diaphragm forming "free" end of the armature/diaphragm 350 is such that the magnetic forces in the air gap 316 just balance the supporting forces. A sound-producing surface 352 is intimately affixed to the magnetically permeable material 358 so as to be integral with the armature structure 350. Compliance-producing surround 354 is also integrally disposed peripherally with sound producing surface 352 and is also continuously affixed to upper support ring 370 and lower support ring 330 on its flexible "surround" periphery 354. An electrical to magnetic coil 360 is wound around a portion 356 of the armature 350 at a position starting near its fixed end. Acoustic cavities 326 and 386 (see FIG. 3*a*) are formed within case structure 310 inside of lower pole 320 to as one form of acoustic tuning means.

Case structure 310 further provides a structural support to the fixed end of the beam 320 as well as the annular magnet 340 and poles 320 and 380.

Figure 4:
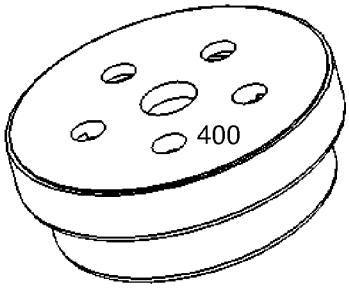
FIG. 4 is a perspective view showing the exterior surface of another exemplary embodiment illustrating some of the principles of the present invention in the form of a "double bent armature" wherein the armature is doubled-back on itself.
Figure 4C:
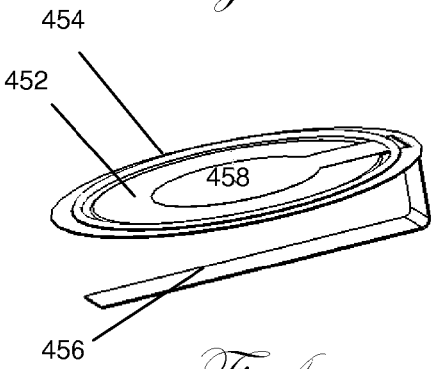
FIG. 4*c* is a perspective view of the integrated armature/diaphragm used in the exemplary embodiment of FIG. 4.
Figure 4B:
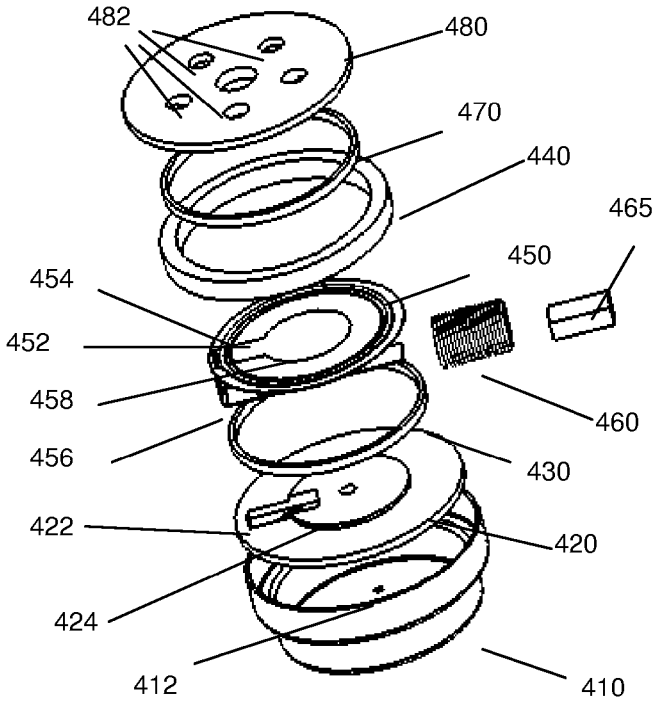
FIG. 4*b* is an exploded view of the exemplary embodiment of FIG. 4.
Figure 4A:
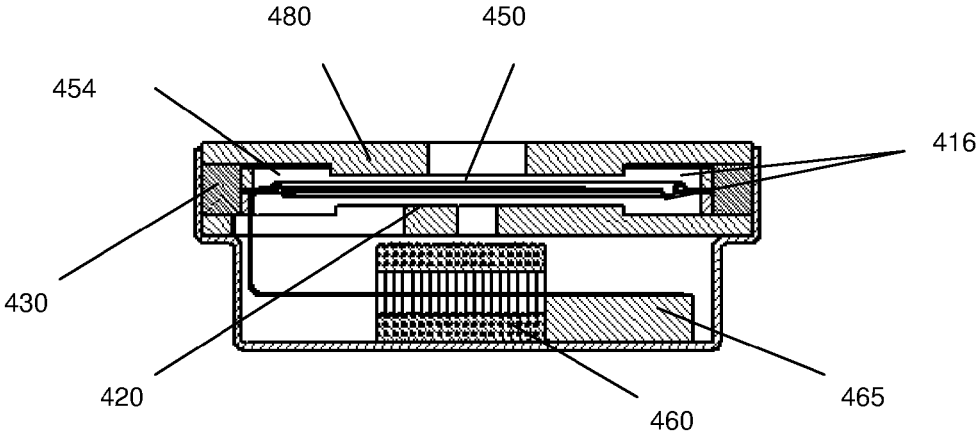
FIG. 4*a* is a cross-sectional view of the exemplary embodiment of FIG. 4.

FIGS. 4, 4*a* and 4*b* show a second exemplary embodiment of the present invention in the form of a "double bent armature" receiver 400. In this exemplary embodiment, a magnetic field is produced in air gap 416 by an annular magnet 440, an upper magnetic pole piece 480 and a lower pole piece 420. Pole pieces 480 and 420 are made of a suitably permeable ferro-magnetic material such as "High mu 80" (Carpenter Steel Corporation), and upper pole piece 480 is configured with openings or holes 482 (see FIG. 4*b*) through which a fluid such as air maintains contiguous relationship with fluid present on the inside of pole piece 480 and its outside boundary. Similarly, opening(s) or hole(s) 422 (see FIG. 4*b*) in lower pole piece 420 provide a pathway through which fluid such as air maintains contiguous relationship with fluid below and above the pole piece 420. The openings 422 so may be continued as shown by other openings, as illustrated by 412, that extend through the bottom case 410. As specifically illustrated, the exemplary embodiment of FIG. 4 shows an annular magnet 440, which may be a permanent magnet or it may be an electromagnet built using well-known principles of winding a coil around a magnetically permeable form and supplying said coil with an electric current to form a magnetic field. The armature 450 (shown in greater detail in FIG. 4*c*) of this exemplary embodiment is comprised of at least a portion of magnetically permeable material 458. The illustrated armature 450 has a cantilevered geometry with a base 456 that is rigidly affixed to lower body structure 410 at mounting block 465. The armature 450 also includes a diaphragm forming "free" end configured and arranged so that the magnetic forces in the air gap 416 just balance the supporting forces. A sound-producing surface 452 is intimately affixed to the armature/diaphragm so as to be integral with the armature/diaphragm structure 450.

A compliance-producing surround 454 is also integrally disposed peripherally with sound producing surface 452 and is also continuously affixed to upper support ring 470 and lower support ring 430 on its flexible "surround" periphery 454. An electrical to magnetic coil 460 is wound around a portion 456 of the armature 450 at a position starting near its fixed end. Acoustic cavities shown as through gap 422 and hole(s) 424 are formed within case structure 410 inside of lower pole 420 to form acoustic tuning means in companion with which may, as shown by 412, or may not entirely proceed from the inner portion of lower pole 420 and through lower case 410 to the external environment. Case structure 410 further provides a structural support to the fixed end of the bent beam 456 through mounting block 465 (see FIG. 4*b*). Mounting block 465 provides support and concentric alignment for the annular magnet 440, magnetic pole pieces 420 and 480 and the support rings 430 and 470.

Figure 5A:
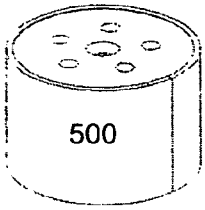
FIG. 5*a* is a perspective view of illustrating the exterior view a further exemplary embodiment utilizing some of the principles of the present invention in the form of a "dual double bent armature having axial aligned sound ports;"
Figure 5B:
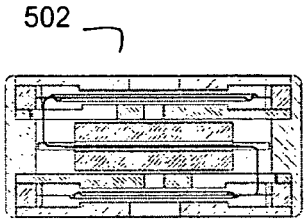
FIG. 5*b* is a cross-sectional view of the exemplary embodiment of FIG. 5*a* illustrating some of the principles of the present invention in the form of a dual diaphragm receiver wherein the armature elements are doubled-back on themselves and the central structure is common to both balanced diaphragm actions.
Figure 5C:
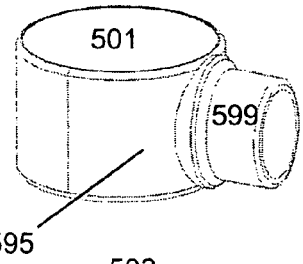
FIG. 5*c* is a perspective view of illustrating the exterior view a further exemplary embodiment utilizing some of the principles of the present invention in the form of a "dual double bent armature having radial aligned sound ports;"
Figure 5D:
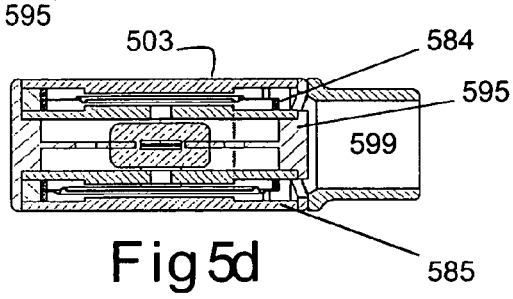
FIG. 5*d* is a cross-sectional view of the exemplary embodiment of FIG. 5*c* illustrating some of the principles of the present invention in the form of a dual diaphragm receiver wherein the armature elements are doubled-back on themselves and the central structure is common to both balanced diaphragm actions.
Figure 5:
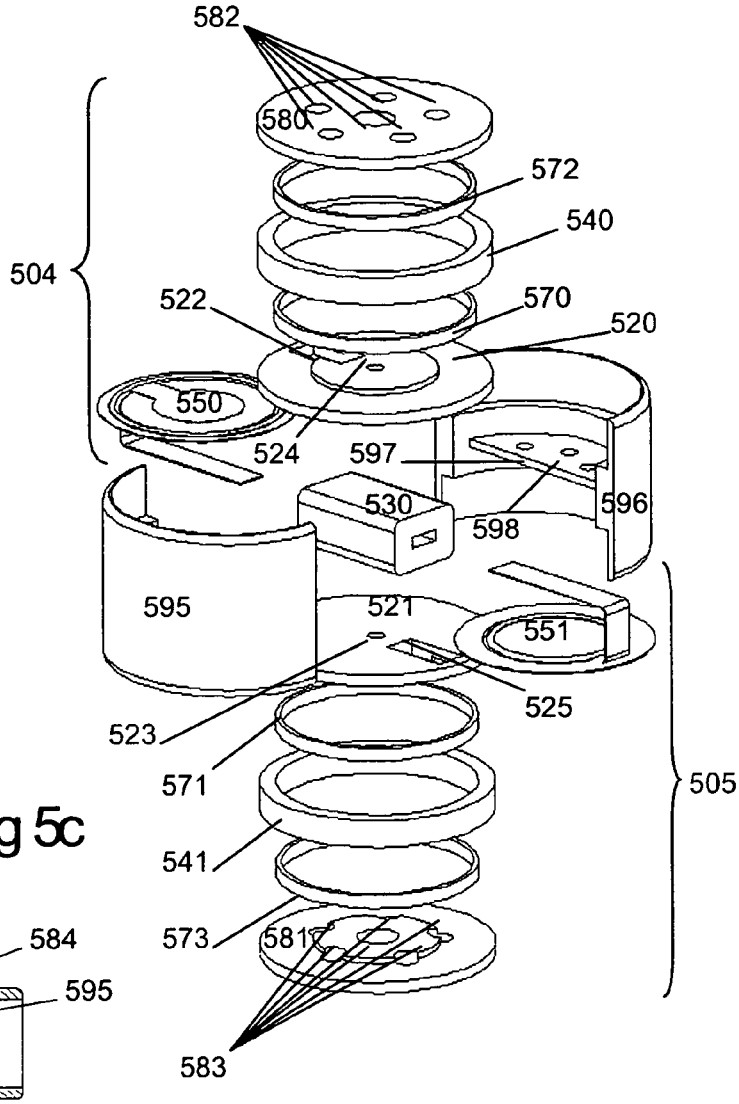
FIG. 5 is an exploded view of illustrating the exterior view a further exemplary embodiment utilizing some of the principles of the present invention in the form of a "dual double bent armature having axial aligned sound ports;"

FIG. 5 illustrates, as an exploded view, a third exemplary embodiment of the present invention in the form of a "dual double bent armatures" receiver. FIGS. 5*a* and 5*b* show a first variation 500, and its cross-section 502 respectively, of the present embodiment having axially-aligned acoustic conduits 582 and 592 emerging from the top and bottom respectively of the device. FIGS. 5*c* and 5*d* show a second variation 501, and its cross-section 503 respectively, of the present embodiment having radial-aligned acoustic conduits 584 and 585 emerging from the side clamshell half 595 respectively of the device, and further combining into the single acoustic nosepiece conduit 599. In general terms, this particular exemplary embodiment depicts two complete electro-mechanical-to-acoustic transducing sections, an upper transducing section 504 and a lower transducing section 505, having similar, but not necessarily identical mechanical to acoustic elements. As most clearly seen in FIG. 5, these units share a common outer supporting structure comprised of two "clamshell style" halves, 595 and 596 respectively, and a common electrical winding in the form of an excitation coil 530. Excitation coil 530 forms a continuous magnetic solenoid with upper diaphragm armature 550 and also with lower diaphragm armature 551 (See FIG. 5). Both of these diaphragm armatures 550 and 551 in this exemplary embodiment are similar in composition to the single armature 450 in the exemplary embodiment illustrated in FIG. 4, and may be comprised of the same detail parts as delineated in connection with that earlier described exemplary embodiment. In the form of the invention represented by the present exemplary embodiment (of FIGS. 5, 5*a*, 5*b*, 5*c*, and 5*d*) the upper diaphragm armature 550 may or may not differ from lower diaphragm armature 551 as is depicted, depending upon the acoustical characteristics desired in any particular variation of the present embodiment. For instance, the upper diaphragm/armature 550 may be more stiffly supported and less massive than lower diaphragm armature 551, and the diameters of the diaphragm armatures, their magnetic permeability, and material composition may be identical or different. In the general exploded representation of the embodiment of FIG. 5, the upper magnetic section of the receiver of this exemplary embodiment is comprised of an uppermost pole piece 580 of magnetically permeable material having aforementioned open acoustic conduits 582 traversing through its thickness, an upper magnetic source ring 540, an upper outer side spacer support ring 572 and an upper inner side spacer ring 570 that each engage the surfaces on the periphery of the diaphragm portion of diaphragm armature 550, and an innermost pole piece 520, which has at least one pole gap 522, a singular feature being required for the passage of diaphragm armature 550 on its way to excitation coil 530, and, optionally, one or more auxiliary passages 524. Similarly, the lower magnetic section of the receiver of this exemplary embodiment is comprised of a lowermost pole piece 581 of magnetically permeable material having aforementioned open acoustic conduits 583 traversing through its thickness, a lower magnetic source ring 541, a lower inner side spacer support ring 571 and a lower outerside spacer ring 573 that each engage the surfaces on the periphery of the diaphragm portion of diaphragm armature 551, and an innermost pole piece 521, which has at least one pole gap 523, a singular feature being required for the passage of diaphragm armature 551 on its way to common excitation coil 530 and, optionally, one or more auxiliary passages 525. Clamshell halves 595 and 596, when assembled as a continuous cylinder, provide physical encasement of the motor and sound producing parts in a stacked concentric fashion. Shelf detail 597 may have one or more conduits 598 as shown in the inner part of clamshell half 596, and a similar structural element may or may not be present in the mating clamshell half 595.

Figure 6A:
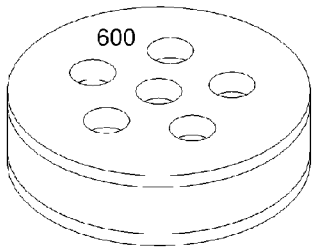
FIG. 6*a* is a perspective view showing the exterior surface of a "solenoidal armature" wherein the armature coil is perpendicular to the armature diaphragm and the sound exit conduits are axially aligned.
Figure 6B:
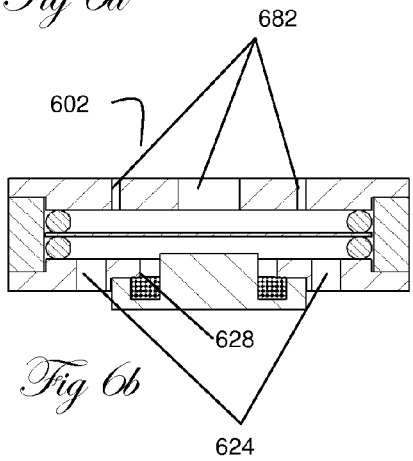
FIG. 6*b* is a cross-sectional view of the exemplary embodiment of FIG. 6*a* illustrating some of the principles of the present invention in the form of a "solenoidal armature" wherein the armature coil is perpendicular to the armature diaphragm and the sound exit conduits are axially aligned.
Figure 6C:
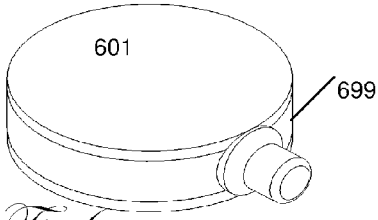
FIG. 6*c* is a perspective view showing the exterior surface of a "solenoidal armature" wherein the armature coil is perpendicular to the armature diaphragm and the sound exit conduits are radial aligned.
Figure 6:
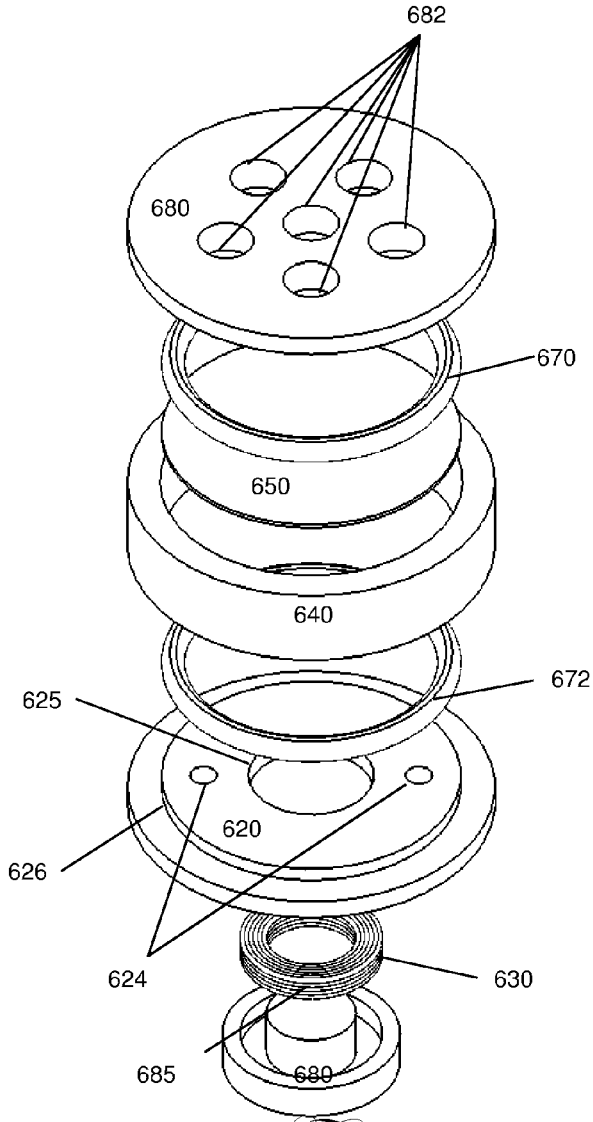
FIG. 6 is an exploded view of another exemplary embodiment illustrating some of the principles of the present invention in the form of a "solenoidal armature" wherein the armature coil is perpendicular to the armature diaphragm.
Figure 6D:
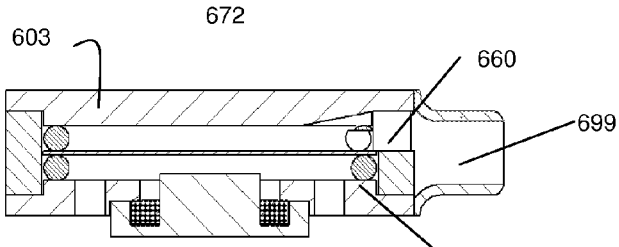
FIG. 6*d* is a cross-sectional view of the exemplary embodiment of FIG. 6*c* illustrating some of the principles of the present invention in the form of a "solenoidal armature" wherein the armature coil is perpendicular to the armature diaphragm and the sound exit conduits are radial aligned.

FIG. 6 illustrates, as an exploded view, a fourth exemplary embodiment of the present invention in the form of a "solenoid induction armature" receiver. FIGS. 6*a* and 6*b* show a first variation 600, and its cross-section 602 respectively, of the present embodiment having axially-aligned acoustic conduits 682 emerging from the device and one or more auxiliary secondary "tuning" acoustic conduits 624 emerging through other elements. FIGS. 6*c* and 6*d* show a second variation 601, and its cross-section 603 respectively, of the present embodiment a having radial-aligned acoustic conduit 684 emerging from the side of the device, and further continuing acoustic nosepiece conduit 699. Appropriate gap features 671 and 673 are provided in this variation of the embodiment in companion with passages 644 and 645 that complete the unobstructed sound conduit connecting the sound-generating surface with the nosepiece conduit 699. In general terms, this exemplary embodiment as most generally depicted in exploded view 600 shows the structure of a device which, while retaining the primary feature of a sound generating surface 650 contained within the static magnetic producing features (upper pole piece 680, magnet 640, and lower pole piece 620,) separates the magnetic flux concentration structure as core 680 with central pole 685 that supports the coil 680, from the sound generating surface 650. An alignment features such as step 628 on lower pole piece 620 is shown in alignment relation with the outer margin of pole piece 680, and an outer step 626 is shown in alignment with magnet 640. A magnetic air gap 625 may be provided between lower pole piece 620 and magnetic core 680. Notwithstanding the geometric separation of these elements (the variable magnetic portion of the armature (coil 630, core 680 and central plate 685 collectively) from the sound producing surface 650, the elements together constitute a single physically (magnetically combined) armature/diaphragm structure. Diaphragm 650 is supported between support rings 670 and 672.

The foregoing description of preferred embodiments of the invention has been presented for purpose of illustration and description. It is not intended to be exhaustive or to limit the invention to the precise form disclosed. Obvious modifications or variations are possible in light of the above teachings. The embodiments were chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims appended hereto.

I claim:

1. An electro-magnetic transducer, comprising:

(a) a housing, the housing including a magnetic structure with at least a pair of magnetic poles of opposite polarity, the pair of magnetic poles creating a first area of magnetic flux concentration;

(b) a vibratable sound-producing member at least partially formed of magnetically permeable material, the sound-producing member having a first end rigidly affixed within the housing and a second vibratable end disposed in the first area of magnetic flux concentration;

(d) a coil positioned to induce a second magnetic field in the sound-producing member, the second end of the sound-producing member being vibratable toward and away from the magnetic poles to produce acoustic waves in the area of magnetic flux in response to electrical current passing through the coil; and (e) an acoustic conduit for receiving sound waves generated by the sound-producing member and directing such waves from the area of magnetic flux concentration through at least one of the magnetic poles to a location outside the housing.

2. An electro-magnetic transducer as recited in claim 1 wherein the sound-producing member is generally positioned in a plane substantially equidistance between the pair of magnetic poles.

3. An electro-magnetic transducer as recited in claim 1 further including a support structure for engaging and supporting the peripheral portions of the sound-producing member.

4. An electro-magnetic transducer as recited in claim 3 wherein the peripheral support structure for the sound-producing member is compliant.

5. An electro-magnetic transducer as recited in claim 2 wherein the sound-producing member includes a diaphragm.

6. An electro-magnetic transducer as recited in claim 1 wherein the sound-producing member is variably vibratable in response to varying electrical current passing through the coil.

7. An electro-magnetic transducer as recited in claim 1 further including a case, the pair of magnetic poles being supported in the case, the case including at least one acoustic conduit aligned with the acoustic conduit extending through said at least one of the magnetic poles, the acoustic conduit extending through one of the magnetic poles and the acoustic conduit of the case jointly forming an acoustic pathway extending from the first area of magnetic flux concentration to an area to outside the case.

8. An electro-magnetic transducer as recited in claim 7 further including at least one acoustic cavity formed within the case.

9. An electro-magnetic transducer as recited in claim 1 wherein the coil is wound around the first end of the sound-producing member.

10. An electro-magnetic transducer, comprising:

(a) a housing, the housing including a magnetic structure with at least a pair of magnetic poles of opposite polarity, the pair of magnetic poles creating a first region of magnetic flux concentration traversing a fluid gap;

(b) a vibratable sound-producing assemblage, the assemblage being at least partially formed of magnetically permeable material and including a sound-generating surface, the sound-producing assemblage having a primary axis that extends from outside of the first region of magnetic flux concentration into the first magnetic flux concentration; and (c) a coil positioned in proximity to the vibratable sound-producing assemblage, the coil being operative in response to a current passing through the coil to induce a magnetic field in the sound-producing assemblage along the primary axis of sound-producing assemblage, the flux lines of the induced magnetic field in the sound-producing assemblage being substantially perpendicular to the flux lines in the first region of magnetic flux concentration.

11. An electro-magnetic transducer as recited in claim 10 wherein the magnetic field induced in the sound-producing assemblage is dynamically variable.

12. An electro-magnetic transducer as recited in claim 10 wherein the magnetic structure includes a magnet having an annular form substantially surrounding the periphery of the sound-generating surface.

13. An electro-magnetic transducer as recited in claim 10 wherein the first region of magnetic flux concentration is a static magnetic field created responsive to an electromagnet.

14. An electro-magnetic transducer as recited in claim 10 wherein the first region of magnetic flux concentration is a dynamic magnetic field created responsive to an electromagnet.

15. An electro-magnetic transducer, comprising:

(a) a housing, the housing including a magnetic structure with at least a pair of magnetic poles of opposite polarity, the pair of magnetic poles creating a first region of magnetic flux concentration traversing a fluid gap;

(b) a vibratable sound-producing assemblage, the assemblage being at least partially formed of magnetically permeable material and including a sound-generating surface, the sound-producing assemblage having a primary axis that extends from outside of the first region of magnetic flux concentration into the first magnetic flux concentration;

(c) an acoustic conduit having a sound conduction path for receiving sound waves generated by the sound-generating surface, the sound conducting path extending substantially perpendicularly to both the sound-generating surface and the primary axis of the sound-producing assemblage; and (d) a coil positioned in proximity to the vibratable sound-producing assemblage, the coil being operative to induce a magnetic field in the sound-producing assemblage in response to a current passing through the coil along the primary axis of sound-producing assemblage, the flux lines of the induced magnetic field in the sound-producing assemblage being substantially perpendicular to the flux lines in the first region of magnetic flux concentration.

16. An electro-magnetic transducer as recited in claim 15 further including an acoustic conduit for receiving sound waves generated by the sound-producing assemblage and directing such sound waves from the first region of magnetic flux concentration through at least one of the magnetic poles to a location outside the housing.

17. An electro-magnetic transducer as recited in claim 15 wherein the sound-producing assemblage has a first end rigidly affixed within the housing and a second end disposed in the first area of magnetic flux concentration.

18. An electro-magnetic transducer as recited in claim 17 further including an acoustic conduit for receiving sound waves generated by the sound-producing assemblage and directing such sound waves from the first region of magnetic flux concentration through at least one of the magnetic poles to a location outside the housing.

19. An electro-magnetic transducer as recited in claim 16 further including a case, the case having at least one acoustic conduit aligned with the acoustic conduit extending through at least one of the magnetic poles, the acoustic conduit extending through at least one of the magnetic poles and the acoustic conduit of the case jointly forming an acoustic pathway from the first area of magnetic flux to an area outside the case.

20. An electro-magnetic transducer, comprising:

(a) a housing comprising a magnetic structure, the structure including at least two magnetic poles of opposite polarity, the magnetic poles creating a first magnetic flux in a first magnetic flux gap region between the magnetic poles;

(b) a vibratable sound producing assemblage comprising a sound-producing member and a magnetically permeable armature, the armature having a beam portion and a base portion at one end of the beam portion, the base portion being rigidly mounted at a location outside of the first magnetic flux gap region, and the armature further comprising a diaphragm portion at a free end of the beam portion, the diaphragm portion being located inside of the first magnetic flux gap region; the sound-producing member being integral with the diaphragm portion and at least partially disposed within the first magnetic flux gap region;

(c) an acoustic conduit defining a sound conduction path for receiving sound waves generated by the sound-generating member, the acoustic conduit extending from a sound-generating surface of the sound-generating member located in the first magnetic flux gap region to a location external of the housing: and (d) a coil around the base portion of the armature at a location outside the first magnetic flux gap region, the coil being operative to induce a second magnetic flux in the armature extending from the base portion to the diaphragm portion of the armature in response to a current passing through the coil.

21. A transducer as recited in claim 20 wherein the second magnetic flux extends from the base portion to the diaphragm portion of the armature through the periphery of the sound-generating member.

22. An electro-magnetic transducer, comprising:

(a) a housing, the housing including a magnetic structure with at least a pair of magnetic poles of opposite polarity, the pair of spaced apart magnetic poles being operable to form a first magnetic flux in a gap region between the magnetic poles;

(b) a vibratable sound-producing assemblage, the assemblage including a sound-generating member, the sound generating member being at least partially disposed within the first magnetic flux gap region between the magnetic poles, the sound-producing assemblage further including a base portion rigidly attached to the housing at a location outside the first magnetic flux gap region, the assemblage being at least partially formed of magnetically permeable material;

(c) an acoustic conduit having a sound conduction path for receiving sound waves generated by the sound-generating member, the acoustic conduit extending from a sound-generating surface of the sound-generating member located in the first magnetic flux gap region to a location external of the housing;

(d) a coil positioned around the base portion of the sound-producing assemblage at a location outside the first magnetic flux gap region, the coil being operative to induce a second magnetic flux in the base portion in response to a current passing through the coil; and (e) a magnetic circuit extending from a position outside the first magnetic flux gap region through the periphery of the sound-generating member for carrying the magnetic flux induced by the coil to a portion of the sound-generating member that is disposed within the first magnetic flux gap region.

* * * * *